US005275270A

United States Patent [19]

Dobó

[11] Patent Number: 5,275,270

[45] Date of Patent: Jan. 4, 1994

[54] HANDRAIL FOR ESCALATORS, MOVING WALKWAYS AND THE LIKE AND A PROCESS FOR ITS PRODUCTION

[76] Inventor: Miklós Dobó, Breitscheider Weg 8, 4030 Ratingen 4, Fed. Rep. of Germany

[21] Appl. No.: 838,404

[22] PCT Filed: Aug. 27, 1990

[86] PCT No.: PCT/DE90/00656

§ 371 Date: Mar. 11, 1992

§ 102(e) Date: Mar. 11, 1992

[87] PCT Pub. No.: WO91/04219

PCT Pub. Date: Apr. 4, 1991

[30] Foreign Application Priority Data

Sep. 12, 1989 [DE] Fed. Rep. of Germany ..... 3930351

[51] Int. Cl.[5] ..... B66B 9/00

[52] U.S. Cl. ..... 198/337

[58] Field of Search ..... 198/337, 847

[56] References Cited

U.S. PATENT DOCUMENTS

| | | | |
|---|---|---|---|
| 2,766,868 | 10/1956 | Tilton | 198/337 |
| 3,688,889 | 9/1972 | Koch et al. | 198/337 |
| 3,778,882 | 12/1973 | Cameron et al. | 198/337 |
| 3,865,225 | 2/1975 | Phal | 198/337 |
| 3,949,858 | 4/1976 | Ballocci et al. | 198/337 |
| 4,852,713 | 8/1989 | Tatai et al. | 198/337 |

FOREIGN PATENT DOCUMENTS

| | | | |
|---|---|---|---|
| 1773183 | 8/1958 | Fed. Rep. of Germany . | |
| 1811982 | 11/1968 | Fed. Rep. of Germany . | |
| 2032667 | 7/1970 | Fed. Rep. of Germany . | |
| 2129172 | 6/1971 | Fed. Rep. of Germany . | |
| 2302602 | 1/1973 | Fed. Rep. of Germany . | |
| 2203178 | 8/1973 | Fed. Rep. of Germany | 198/337 |
| 2124634 | 9/1972 | France | 198/337 |
| 557295 | 12/1973 | Switzerland . | |
| 1260299 | 1/1972 | United Kingdom | 198/337 |

*Primary Examiner*—James R. Bidwell

*Attorney, Agent, or Firm*—Diller, Ramik & Wight

[57] ABSTRACT

Handrails for escalators, moving walkways and the like consist of an endless, flexible strip (1) with a gripping region (2) and guiding regions (4) which, in operation, slide on a fixed guideway, and steel cables which are embedded in the strip (1) and serve as tensile supports. In order to be able to produce the handrails more simply and with less outlay, the strip (1) is divided in its longitudinal direction into individual segments (5, 6, 7) which follow closely upon one another, the segments being molded firmly around the steel cable (3). The segments can be injection molded around the steel cables (3), a thermoplastic elastomer being used.

14 Claims, 1 Drawing Sheet

HANDRAIL FOR ESCALATORS, MOVING WALKWAYS AND THE LIKE AND A PROCESS FOR ITS PRODUCTION

BACKGROUND OF THE INVENTION

The invention relates to a handrail for escalators, moving walkways and the like, comprising an endless, flexible strip with a gripping region and a guiding region which, in operation, slide on a fixed guideway, and one or more tensile supports embedded in the strip and consisting of high-strength materials with limited extensibility and to a process for its production.

Known handrails of the said type consist of continuous endless strips of natural or synthetic rubber with incorporated reinforcing layers. Although these known handrails have given excellent results in operation, their production is extremely complicated. The known handrails are produced in the form of full-length handrails or in long lengths and must then be vulcanized length by length, for which purpose they must each be processed in a vulcanization press. After vulcanizing, the handrail is joined together to form an endless loop in a relatively complicated and not always satisfactory manner.

Furthermore, so-called link-type handrail strips are known, which are made up of individual elements of the same cross-section. In this arrangement, the elements are either connected to one another directly (German Patent Specification 1,811,982) or are mounted on a common, continuous drag chain (U.S. Pat. No. 2,766,886). The disadvantage of the known link-type handrail strips consists in the fact that they exhibit excessively high elongation in the direction of running since the play between each pair of elements due to the production and assembly methods adds up cumulatively over the whole length to an impermissibly large play. This is particularly the case with wear after prolonged running and is noticeable by a sharp rise in the running noise. A further disadvantage is the wear which arises due to the friction between the individual elements and the guide rails.

From U.S. Pat. No. 2,778,882 a handrail is known which is made up of plastic bodies and an endless covering of elastic plastics material or rubber. The basic bodies which are made of solid plastics material are individually or in groups, formed in distance around tensile ropes. To get a continuous condition for the covering, the mutually facing sides of the basic bodies are supplied with projected, on space arranged spouts.

SUMMARY OF THE INVENTION

The object on which the invention is based is to provide a handrail of the type stated at the outset which can be produced more simply and with lower outlay while retaining the good characteristics of previous designs.

This object is achieved according to the invention by the fact that the strip is divided in its longitudinal direction into individual segments, which follow closely upon one another, and are molded firmly around the continuous support and the segments encircle the stationary course and are supplied with a gripping area as well as a sliding area.

The handrail according to the invention has the advantage that complete segments can be produced independently of one another in close succession, either individually or in groups, being molded around the continuous tensile support. The tensile support can thus be encapsulated in the individual segments in the same operation in which the individual segments are produced. As an alternative, however, it is also possible to produce the individual segments separately beforehand and connect them firmly to the tensile support in a second operation, for example by bonding, welding or the like. An additional continuous cover is not necessary.

Due to the concept according to the invention, it is furthermore also possible for the segments forming the strip to be formed by a thermoplastic elastomer. These segments can be molded around the tensile support by an injection molding or blow molding method. As an alternative, the segments can also be produced from expandable polyurethane using the RIM method.

The successive segments, which expediently have an approximately rectangular shape in plan view, can in the gripping area overlap one another. This ensures that the handrail is closed towards the outside, eliminating the risk of injury to the user.

The region of overlap can be formed by flat tongues which project in the axial direction and engage in a corresponding recess of the following segment. The tongues extend either only in the region of the upper side of the handrail strips or around their entire cross-section.

Each segment expediently has a flat projecting tongue at one of its ends which extends at least over the entire width of the gripping area and a recess matched to said tongue at its other end. As a result, all the segments consist of identical molded parts which can be produced in the same mold or in the same group of molds.

The upper sides of the tongues are preferably in the plane of the upper sides of the segments, giving a continuously smooth surface during the operation of the handrail strip.

In the region of the tensile support, the lower sides of the tongues expediently lie above said support, the good flexibility of the strip thus being retained.

In another illustrative embodiment of the handrail, the mutually facing sides of the segments in the gripping area can each be provided with a projecting deformable flat lip, the lips resting closely against one another, thereby forming a continuous unbroken handrail.

With the tensile support stretched, the lips preferably rest against one another under prestress, providing reliably sealed interconnection of the gripping part.

The tensile support is expediently formed by a plurality of steel cables extending parallel to one another. These can be arranged in one plane with mutual spacing. At least during connection to the individual segments, the steel cables should be under pretension, thus guaranteeing that all the steel cables provide support.

The ends of the steel cables preferably overlap one another in their connection region during the joining together to form an endless loop, the ends pointing in opposite directions, and are surrounded jointly by at least one segment. An externally invisible connection region is thereby created which can be produced without additional outlay. The segment or segments in the transition zone are produced in the same molds as the other segments. Such a connection can be produced considerably more easily and to a higher standard than a vulcanized connection in accordance with the prior art.

In the connection region, the ends of the steel cables are expediently arranged adjacent to one another alternately in the same plane, with the result that no damaging moments can arise when a tensile force is applied.

If the segments are produced from a thermoplastic elastomer, they can be provided in the region of their sliding surfaces with integrally molded projecting knobs, for example in the form of spherical caps, it thereby being possible to reduce the frictional force in relation to the fixed guideway on which the handrail slides.

In the region of their sliding or driving surfaces, the segments can, as an alternative, also be provided with molded-in sliding or adhesive layers, for example with textile layers, which are placed in the mold before the initiation of the injection molding or blow molding process or are fed in some other way.

The successive segments can be provided with a continuous covering which overlaps them.

The method according to the invention for producing a handrail is distinguished by the fact that a length of the tensile support is placed in a mold, those regions of the tensile support which adjoin this length being passed through openings situated in a parting line of the mold, that in the mold, a segment being provided with a gripping area as well as a sliding area is molded around the tensile support and, on completion, is removed from the opened mold together with the tensile support, and that a length adjoining the segment is then placed in the mold and surrounded with a further segment etc.

Where the segments are of simple configuration, without undercuts, the injection mold or blow mold can surround the respective segment completely. Where the segments are of complicated configuration, with undercuts, the injection mold or blow mold can be open on the side which faces the adjoining, already completed segment being pulled in on this side to close the mold and acting as part of the mold.

A very simple possibility for getting a pretension between the segments is to bend the tensile supports during the production of the segments.

If the method according to the invention is used, it is also readily possible to produce a plurality of segments simultaneously in a common mold or in separate molds arranged adjacent to one another.

If the segments are produced from a thermoplastic elastomer, the tensile support in the closed mold can be encapsulated by the melt of the thermoplastic elastomer.

If the tensile support consists of parallel steel cables, then after reaching the prescribed length, the strip can be joined together to form an endless loop by placing both ends of the steel cables simultaneously in the mold or in a plurality of adjacent molds and embedded in a segment or a plurality of segments.

On completion of the handrail, a continuous covering can be applied to the latter, the said covering overlapping the individual segments. The application of the covering can be accomplished by producing it by continuous extrusion.

The invention is illustrated by way of example in the drawing and described in detail below with reference to the drawing, in which:

DESCRIPTION OF THE PREFERRED EMBODIMENT

Figure 1:
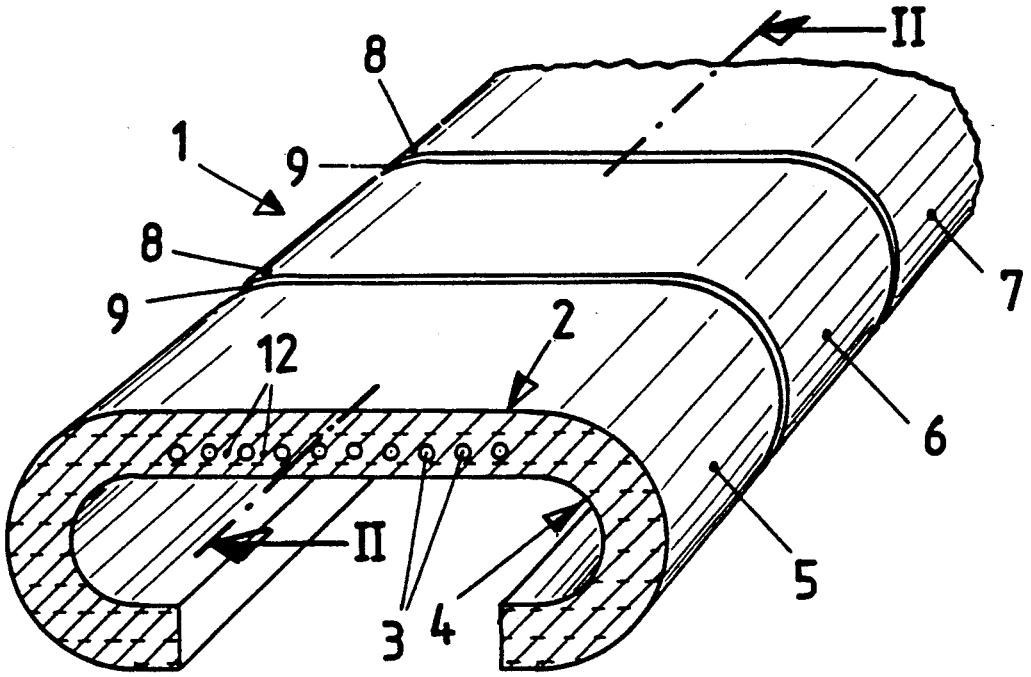
FIG. 1 shows, in perspective representation, a length of a handrail strip.

FIG. 1 of the drawing shows a short length of an endless, flexible handrail strip 1 provided for escalators, moving walkways or the like.

The handrail 1 has a gripping region 2 and sliding regions 4 which, in the assembled condition of the handrail strip 1, engage around a fixed guideway (not shown in the drawing), on which the driven handrail strip 1 can slide. Embedded in the upper region of the handrail strip 1 are ten steel cables 3, which serve as tensile supports.

Figure 2:
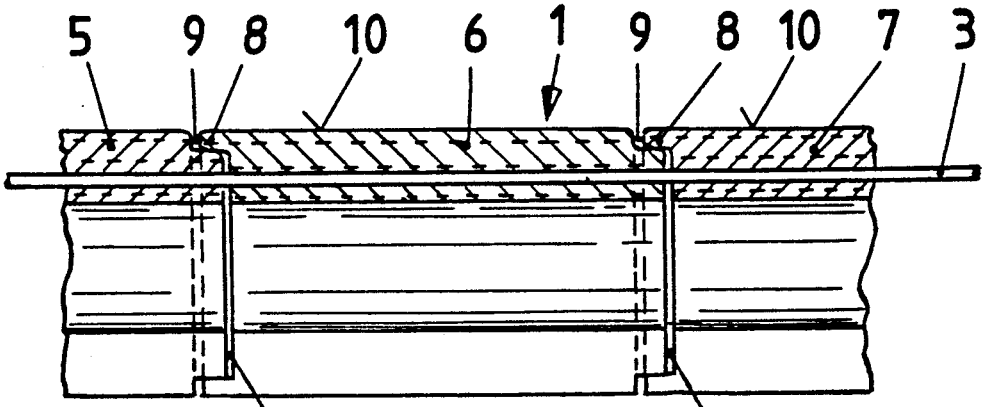
FIG. 2 shows a section along the line II—II in FIG. 1.

As can be seen from FIGS. 1 and 2, the handrail strip 1 is divided in its longitudinal direction into individual segments 5, 6, 7 which follow closely upon one another and have an approximately rectangular shape in plan view.

As can be seen, in particular, from FIG. 2, the successive segments 5, 6, 7 overlap one another. In this arrangement, each segment 5, 6, 7 has a projecting tongue 8 at one of its ends and a recess 9 matched to said tongue at its other end. All the segments 5, 6, 7 are of identical design. Thus, for example, the tongue 8 of segment 6 engages in the recess 9 of segment 5 while the tongue 8 of segment 7 engages in the recess 9 of segment 6.

The upper sides of the tongues 8 lie in the same plane as the upper sides 10 of the segments 5, 6, 7, i.e. on one side of the segments 5, 6, 7, the tongues 8 virtually form an extension of the surface 10. The lower sides of the tongues 8 lie above the steel cables 3.

The recesses 9 of the segments 5, 6, 7 are of step-shaped design, the height of each step corresponding approximately to the thickness of a tongue 8. The lower sides of the tongues 8 in each case rest on the upper sides of the steps of the recess 9, so that the gaps between the individual segments 5, 6, 7 are thereby bridged.

The tongues 8 extend at least over the entire width of the gripping part 2, with the result that the upper side of the handrail strip 1 is almost smooth. However, it is also possible for the tongues 8 to extend over the entire outward-facing region of the segments 5, 6, 7, each gap 11 between the individual segments thus being covered all the way around. In that case, the recesses 9 too correspondingly extend over the entire outer region of the respective segments.

The segments 5, 6 and 7 of the illustrative embodiment of the handrail strip 1 depicted in FIGS. 1 and 2 are manufactured from a thermoplastic elastomer. The individual segments 5, 6, 7 can accordingly be produced by an injection molding method. For this purpose, the steel cables 3 are passed under the same pretension through openings in a corresponding mold and then, with the mold closed, encapsulated with the melt of a thermoplastic elastomer. After the melt has cooled, the mold is opened and the finished segment is removed from the mold axially relative to the pretensioned wire cables, the wire cables for the next segment being introduced into the mold. The operation is then repeated for as many times as desired. The mold is designed in such a way that the spacing between the segments is extremely small, each gap 11 between the individual segments thus remaining less than 2 mm. The number of segment cavities in the mold can vary according to the size of the injection molding machine. In the case of a very small injection molding machine, each segment is, for example, produced individually while, in the case of a larger injection molding machine, ten segments can, for example, be produced simultaneously.

After the requisite length has been reached, the handrail strip 1 can be joined together to form an endless loop by placing the two ends of the steel cables 3 simultaneously in the corresponding mold or in a plurality of molds and embedding them in the segments by injecting the thermoplastic elastomeric material. After the segments have cooled, the ends of the steel cables are firmly connected to one another. To ensure that no moment on the steel cables can arise in the respective region of overlap of the steel cables when a tensile force is applied, both ends of the steel cables lie in one plane. If, for example, in FIG. 1, the steel cables 3 are regarded as ends, the other ends would be inserted precisely in the spaces 12 between the steel cables 3.

It is nowadays possible to obtain thermoplastic elastomers of very great hardness, making it possible to dispense with the otherwise customary textile reinforcements for a handrail strip manufactured from these materials. This considerably simplifies the structure of the handrail strip.

When using the injection molding method, it is possible to achieve significantly narrower manufacturing tolerances than with conventional vulcanizable rubber blends and a better handrail strip quality can be expected as a result. The injection molding method furthermore gives an excellent surface finish and the handrail strip is thus of good quality from the visual aspect as well. The same applies to color grades, which can be maintained with very great precision.

It is furthermore possible to print on the segments produced from the thermoplastic elastomers and they can thus also be used as advertising media.

Virtually all thermoplastic elastomers, such as polyurethanes, elastomer blends, copolyesters and the like, are suitable as a production material.

The steel cables 3 embedded in the segments 5, 6, 7 are preferably produced from stainless steel or subjected to a surface treatment to ensure that they do not rust. As an alternative, the steel cables can also be coated with a thermoplastic elastomer.

Handrail strips produced from thermoplastic elastomers also have very little impact on the environment upon disposal since the thermoplastic material can be recycled.

The process is extremely sparing of energy in comparison with conventional vulcanized handrail strips, since neither high pressures nor relatively high temperatures have to be maintained for prolonged periods.

Figure 3:
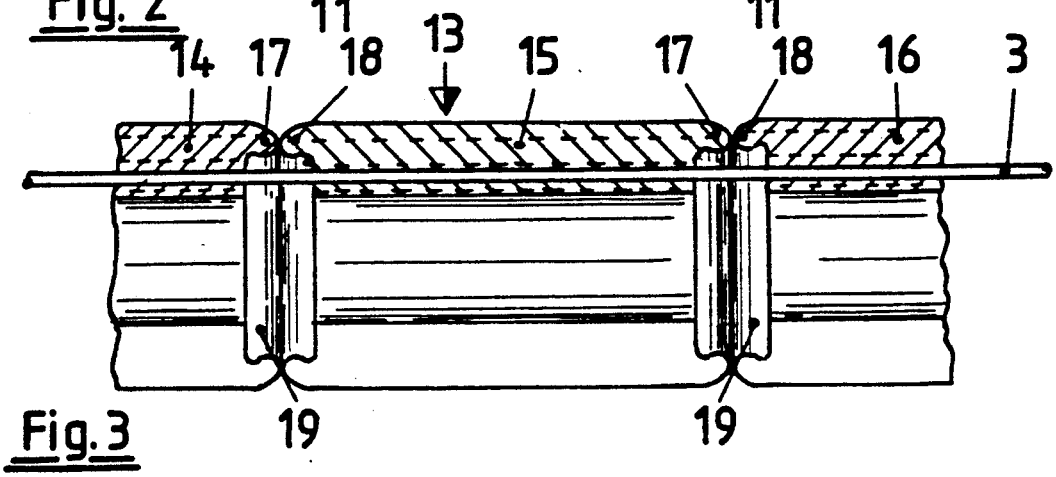
FIG. 3 shows a section similar to that in FIG. 2 through another illustrative embodiment of a handrail strip.

As a departure from the illustrative embodiment depicted in FIGS. 1 and 2, it is also possible to provide the handrail strip with different constructional features. In the illustrative embodiment depicted in FIG. 3, the handrail strip 13 is made up of segments 14, 15, 16 which, as in the illustrative embodiment depicted in FIGS. 1 and 2, consist of a thermoplastic elastomer. The segments 14, 15, 16 are injection molded in closely packed succession around steel cables 3, which serve as tensile supports in the handrail strip 13.

At each of the two ends, the segments 14, 15, 16 have a projecting lip 17 and 18 respectively, the lips 17 and 18 of two adjacent segments resting closely against one another. Thus, for example, the lip 17 of segment 15 rests against the lip 18 of segment 14, while the lip 18 of segment 15 rests against the lip 17 of segment 16. With the steel cables 3 stretched, the lips rest against one another under prestress and the interspaces 19 between the individual segments are thus tightly bridged.

The production process is performed in the same way as in the case of the illustrative embodiment in accordance with FIGS. 1 and 2. In order, however, to ensure that the lips 17 and 18 rest against one another under prestress when the steel cables are stretched, the steel cables 3 are, for example, bent during the injection molding of the segments. In the stretched condition of the steel cables 3, the lips 17 and 18 of the successive segments then automatically rest against one another under prestress.

Alternatively, the lip 18 of the already finished segment 15 can, for example, also be pressed against segment 15 while segment 16 with its opposite lip 17 is being produced by injection molding. After segment 16 has been finished, the lip 18 of segment 15 is released again and the two adjacent lips 17 and 18 thus then necessarily rest against one another under prestress.

In all embodiments of the handrail strip 1 and 13, respectively, the tensile supports or steel cables 3 should be under pretension, thus ensuring that the segments rest closely against one another and, at the same time, that all the cables 3 help to bear the load.

Given appropriate pairing between the materials of the segments and the fixed guideway on which the handrail strip formed by the segments slides, no measures need be taken to improve the sliding properties. However, it would be possible to form knobs in the shape of spherical caps on the inner side of the segments in order to reduce friction and these could readily be produced in a single operation during the injection molding of the segments. As an alternative, it would also be possible, as in conventional handrail strips, to use textile inner layers placed in the mold before injection molding.

LIST OF DESIGNATIONS

1—Handrail strip
2—Gripping region
3—Steel cable
4—Sliding regions
5—Segment
6—Segment
7—Segment
8—Tongues
9—Recesses
10—Upper sides
11—Gap
12—Spaces
13—Handrail strip
14—Segment
15—Segment
16—Segment
17—Lip
18—Lip
19—Interspaces

What is claimed is:

1. A handrail strip (1) comprising a plurality of individual hand grip segments (5, 6, 7; 14, 15, 16) in substantially end-to-end contiguous longitudinally aligned relationship to each other; at least one relatively long tensile supporting means (3) for maintaining said hand grip segments generally in said end-to-end contiguous longitudinally aligned relationship, surface means of said hand grip segments molded in situ upon and in intimate contacting and surrounding relationship to said supporting means (3) for holding said hand grip segments (5, 6, 7; 14, 15, 16) secured to said supporting means (3), each of said hand grip segments having upper surfaces contoured to collectively define a continuous gripping plane along the total length of said handrail strip for generally unobstructed gripping thereof by the hand of a user, and surface means for effecting the guiding of said hand grip segments along an associated support.

2. The handrail strip as defined in claim 1 wherein each of said hand grip segments (5, 6, 7; 14, 15, 16) is formed of synthetic polymeric/copolymeric thermoplastic material.

3. The handrail strip as defined in claim 1 wherein each of said hand grip segments is blow molded in situ upon said supporting means.

4. The handrail strip as defined in claim 1 wherein each of said hand grip segments is injection molded in situ upon said supporting means.

5. The handrail strip as defined in claim 1 wherein said hand grip segments have axially opposite end portions, and end portions of adjacent hand grip segments are in overlapping relationship to each other.

6. The handrail strip as defined in claim 1 wherein said hand grip segments have axially opposite end portions, end portions of adjacent hand grip segments are in overlapping relationship to each other, and said end portions of each hand grip are defined by opposite tongues and recesses.

7. The handrail strip as defined in claim 1 wherein said hand grip segments have axially opposite end portions, end portions of adjacent hand grip segments are in overlapping relationship to each other, and said end portions of each hand grip are defined by oppositely directed tongues.

8. The handrail strip as defined in claim 1 wherein said hand grip segments have axially opposite end portions, end portions of adjacent hand grip segments are in overlapping relationship to each other, said end portions of each hand grip are defined by oppositely directed tongues, and tongues of adjacent hand grip segments are in abutting deformed engagement with each other.

9. The handrail strip as defined in claim 1 wherein opposite end portions of adjacent hand grip segments are in abutment with each other, and said tensile supporting means (3) defines a closed loop under pretension thereby assuring intimate abutment of adjacent hand grip segments and portions.

10. The handrail strip as defined in claim 1 wherein said tensile supporting means (3) is a closed loop having end portions embedded in one of said hand grip segments.

11. The handrail strip as defined in claim 10 wherein said closed loop is under pretension thereby assuring intimate abutment of adjacent hand grip segments end portions.

12. The handrail strip as defined in claim 11 wherein each of said hand grip segments (5, 6, 7; 14, 15, 16) is formed of synthetic polymeric/copolymeric thermoplastic material.

13. The handrail strip as defined in claim 11 wherein each of said hand grip segments is blow molded in situ upon said supporting means.

14. The handrail strip as defined in claim 11 wherein each of said hand grip segments is injection molded in situ upon said supporting means.

* * * * *